US010826155B2

(12) United States Patent
Roy

(10) Patent No.: US 10,826,155 B2
(45) Date of Patent: Nov. 3, 2020

(54) TECHNICIAN PLATFORM FOR ANTENNA MOUNT

(71) Applicant: CommScope Technologies LLC, Hickory, NC (US)

(72) Inventor: Dino Roy, Saginaw, TX (US)

(73) Assignee: CommScope Technologies LLC, Hickory, NC (US)

( * ) Notice: Subject to any disclaimer, the term of this patent is extended or adjusted under 35 U.S.C. 154(b) by 561 days.

(21) Appl. No.: 15/700,688

(22) Filed: Sep. 11, 2017

(65) Prior Publication Data

US 2018/0083337 A1 Mar. 22, 2018

Related U.S. Application Data

(60) Provisional application No. 62/395,530, filed on Sep. 16, 2016.

(51) Int. Cl.
*H01Q 1/12* (2006.01)
*H01Q 1/24* (2006.01)

(52) U.S. Cl.
CPC ..... *H01Q 1/12* (2013.01); *H01Q 1/1228* (2013.01); *H01Q 1/246* (2013.01)

(58) Field of Classification Search
CPC .. H01Q 1/1242; H01Q 1/1207; H01Q 1/1247; H01Q 1/1228; E04H 12/08; E04H 12/085
See application file for complete search history.

(56) References Cited

U.S. PATENT DOCUMENTS 5,467,955 A * 11/1995 Beyersmith ..... H01Q 1/1242 248/219.3
5,971,345 A * 10/1999 Khalaf ..... H01Q 1/125 248/512
7,113,145 B1 9/2006 Noble
2007/0205957 A1 9/2007 Chapman
2011/0279347 A1 11/2011 Pass et al.
2012/0174498 A1* 7/2012 Anderson, Jr. ..... A01M 29/32 52/101
2012/0234992 A1* 9/2012 Vanover ..... F16M 11/2021 248/201

FOREIGN PATENT DOCUMENTS

JP 2016089601 A * 5/2016 ..... E04G 3/30

OTHER PUBLICATIONS

International Preliminary Report on Patentability corresponding to International Application No. PCT/US2017/050891 dated Mar. 28, 2019.

(Continued)

*Primary Examiner* — Ricardo I Magallanes
(74) *Attorney, Agent, or Firm* — Myers Bigel, P.A.

(57) ABSTRACT

A work platform mounted to an antenna frame includes: an antenna frame comprising a plurality of horizontal members and a plurality of vertical members mounted on the horizontal members; at least one piece of communications equipment mounted on one of the plurality of vertical members; and a work platform mounted on at least two of the vertical members, one of the vertical members on which the work platform is mounted being the vertical member on which the communications equipment is mounted.

6 Claims, 10 Drawing Sheets

(56) References Cited

OTHER PUBLICATIONS

U.S. Appl. No. 15/000,036, Skrepcinski et al., filed Jan. 19, 2016.
U.S. Appl. No. 15/139,057, Skrepcinski et al., filed Apr. 26, 2016.
Sabre Industries, Inc. "T-Arm Work Platform Assemblies" https://www/sabresitesolutions.com/en/Image/GetDocument/147 retrieved Oct. 1, 2008 (1 page).
Notification of Transmittal of the International Search Report and the Written Opinion of the International Searching Authority, or the Declaration corresponding to International Application No. PCT/US2017/050891; dated Nov. 29, 2017.

* cited by examiner

TECHNICIAN PLATFORM FOR ANTENNA MOUNT

RELATED APPLICATION

The present application claims priority from and the benefit of U.S. Provisional Patent Application No. 62/395,530, filed Sep. 16, 2016, the disclosure of which is hereby incorporated herein in its entirety.

FIELD OF THE INVENTION

The present invention relates generally to mounts for antennas, and more particularly to mounts for antennas on an antenna tower or monopole.

BACKGROUND

With increased demand for more wireless communication, the number of radio and antenna units that a tower traditionally supports has increased and is expected to continue to increase. New towers are being designed to support greater numbers of antenna and radio units, while existing towers are retrofitted to support more units, and effort is made to fully utilize space available on the towers.

In addition, antennas are becoming larger in order to handle more wireless traffic. One parameter that influences antenna design is Effective Projected Area (EPA), which is determined by calculations defined by TIA/ANSI-222-C, EPA is intended to predict the effect of wind loading on an antenna structure to enable designers to create a safe design. The configuration of the antenna mount can impact the calculations. As such, reducing or minimizing an antenna mount's contribution to EPA can be desirable.

In addition, because antennas are typically mounted on towers well above the ground, technicians working on the antennas and their mounts are at some risk. As a result, a mount design that can reduce the time a technician spends on the tower may also be desirable, as may be a mount design that provides greater safety for the technician.

SUMMARY

As a first aspect, embodiments of the invention are directed to an assembly, comprising: an antenna frame comprising a plurality of horizontal members and a plurality of vertical members mounted on the horizontal members; at least one piece of communications equipment mounted on one of the plurality of vertical members; and a work platform mounted on at least two of the vertical members, one of the vertical members on which the work platform is mounted being the vertical member on which the communications equipment is mounted.

As a second aspect, embodiments of the invention are directed to an assembly, comprising: an antenna frame comprising a plurality of horizontal members and a plurality of vertical members mounted on the horizontal members; at least one piece of communications equipment mounted on one of the plurality of vertical members of the antenna Frame; and a work platform mounted on at least two vertical members, each of the vertical members including a locking bracket that engages one of the horizontal members of the antenna frame, the locking bracket including a portion that overlies the horizontal member from above to prevent downward slipping of the work platform relative to the horizontal member under load.

As a third aspect, embodiments of the invention are directed to an antenna tower, comprising: a generally vertically disposed tower structure; three antenna mounts mounted to the tower structure; three antenna frames, each of the antenna frames mounted to a respective antenna mount; and three work platforms, each of the work platforms mounted to a respective antenna mount or to a respective antenna frame.

DETAILED DESCRIPTION

Figure 1:
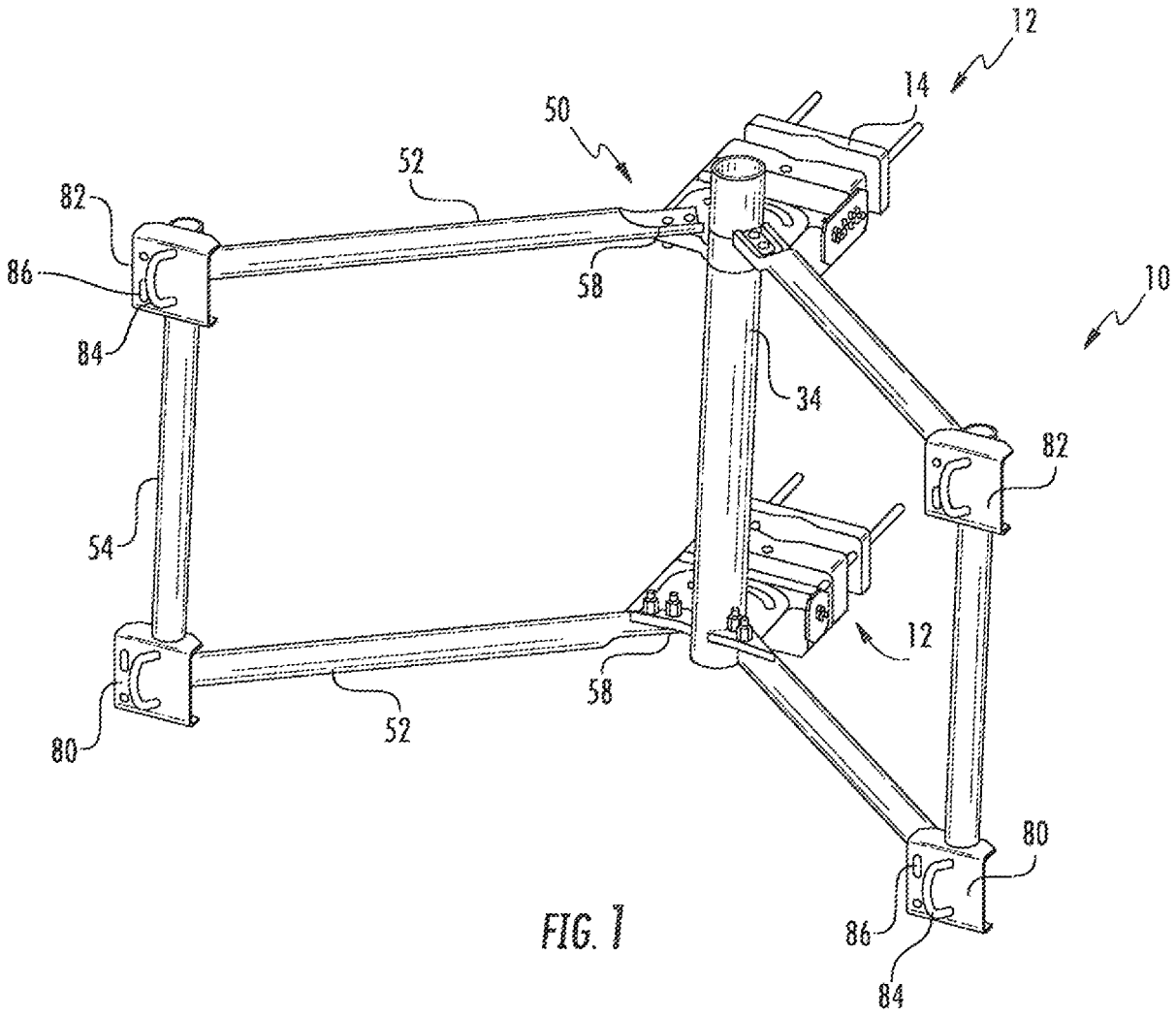
FIG. 1 is a front perspective view of an antenna mount according to embodiments of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs, it will be further understood that terms, such, as those defined in, commonly used dictionaries, should be, interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and V" and "between about X and Y" should be interpreted to include X and Y. As used herein, phrases such as "between about X and V" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Referring now to the figures, an antenna mount, designated broadly at 10, is shown in FIGS. 1-4. The mount 10 includes two pipe clamps 12, each of which includes rear and front pipe clamping jaws 14, 16 connected by bolts 18. The pipe clamps 12 are configured to clamp to a leg of an antenna tower or other mounting structure positioned between the rear and front clamping jaws 14, 16 when the bolts 18 are tightened.

Figure 3:
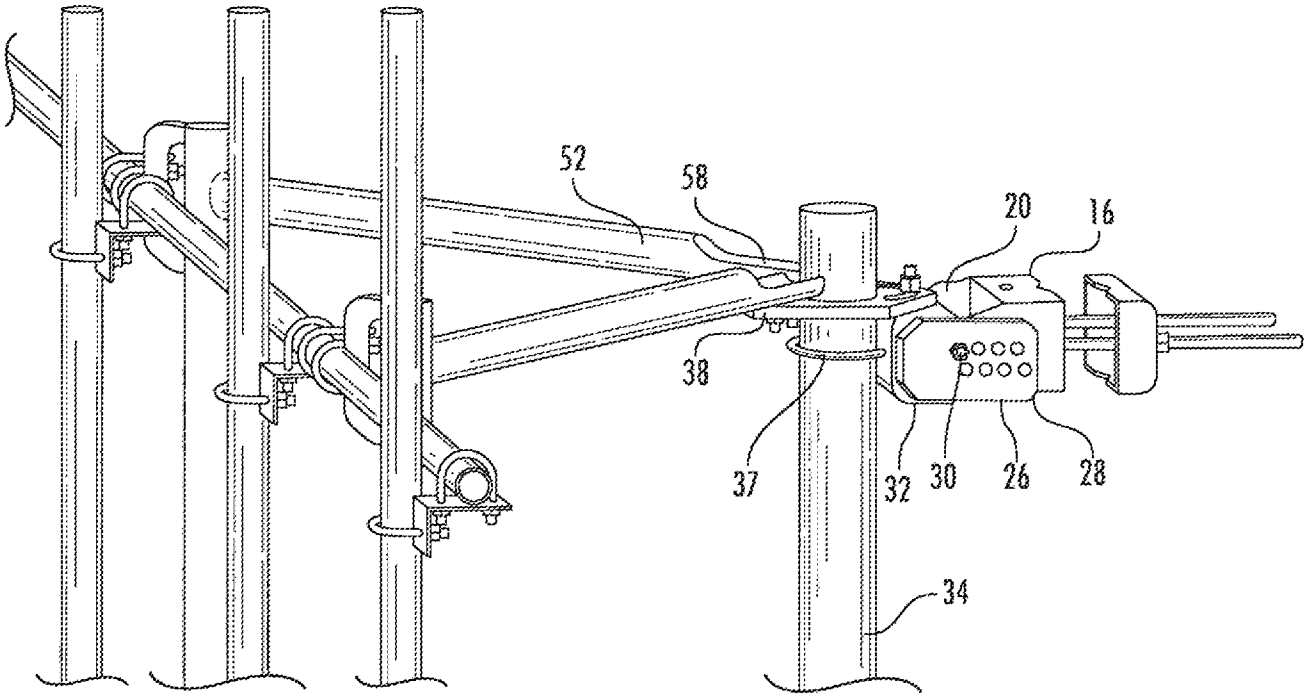
FIG. 3 is a partial front side perspective view of the antenna mount of FIG. 1 with an equipment frame mounted thereon.
Figure 4:
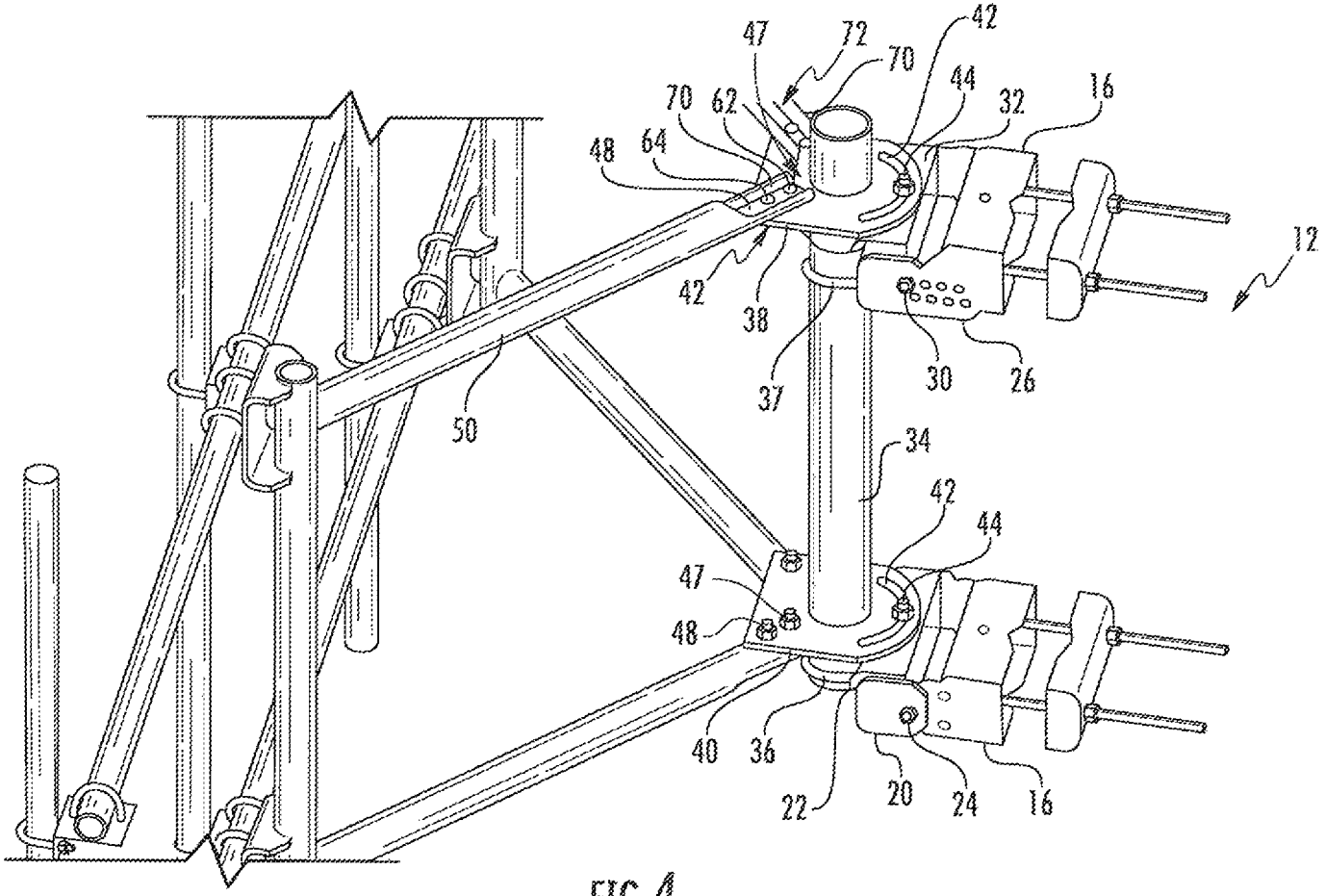
FIG. 4 is a partial rear side perspective view of the antenna mount and frame of FIG. 3.

As can be seen in FIG. 4, two side panels 20 are fixed to opposite side walls of a lower U-bolt bracket 22. Also, each of the side panels 20 is mounted to the lower front clamping jaw 16 via a bolt 24 about which the side panels 20 can pivot. Two side panels 26 are mounted to opposite side walls of an upper U-bolt bracket 32 also, but the side panels 26 include a plurality of mounting holes 28 arranged in two rows, through which a bolt 30 mounts the side panels to the upper clamping jaw 16 (FIG. 3). The plurality of mounting holes 28 enables the relative position of the upper U-bolt bracket 32 to the upper front clamping jaw 16 to be varied, which in turn varies the "tilt" angle of an antenna mounted to the antenna tower to be selected as needed. Each of the holes 28 may be regularly spaced from the other holes 28 to provide incrementally increasing angular tilt; for example, the rightmost hole 28 shown in FIG. 3 may correspond to zero tilt angle, the next rightmost hole 28 may correspond to one degree of tilt, the next, rightmost hole 28 may correspond to two degrees of tilt, and so on. Those skilled in this art will recognize that other bases or foundations for mounting of the upper and lower U-bolt brackets to an antenna tower or other mounting structure may be employed.

FIGS. 3 and 4 illustrate that the lower and upper U-bolt brackets 22, 32 are mounted to a cylindrical vertical post 34 via respective U-bolts 36, 37. Upper and lower azimuth adjustment plates 38, 40 are fixed to the vertical post 34. Each of the upper and lower azimuth adjustment plates 38, 40 has an arcuate slot 42 near its rear edge; the arcuate slot 42 has a radius of curvature that is substantially collinear with an axis defined by the vertical post 34. An adjustment bolt 44 (or other adjustment, member, such as, a pin or the like) is inserted, through the slot 42 and into a hole in the upper surface of the corresponding U-bolt bracket 22, 32. When the adjustment bolt 44 is loosened, the upper and lower azimuth plates 38, 40 (and, in turn, the vertical post 34 and structures mounted thereto) are free to rotate relative to the lower and upper U-bolt brackets 22, 32 about the vertical axis defined by the post 34. Thus, the azimuth of an antenna mounted on the mount 10 can be adjusted by simply loosening the adjustment bolts 44, rotating the antenna into the desired position, and tightening the adjustment bolts 44.

Referring still to FIGS. 3 and 4, two frame mounting holes 47, 48 are located near the front corners of the azimuth plates 38, 40. The holes 47, 48 are arranged such that one pair of holes 47, 48 defines an axis that forms a substantially horizontal angle of 120 degrees with the axis defined by the other pair of holes 47, 48 in the azimuth plates 38, 40.

Referring now to FIGS. 1-4, two generally C-shaped arms 50 are attached at their ends to the upper and lower azimuth plates 38, 40. Each of the arms 50 includes two horizontal runs 52 and a vertical run 54, which in some embodiments are formed as a monolithic component (for example, via welding). At the free ends of the horizontal runs 52, the ends of the arms 50 have flattened sections 58 with two holes. Bolts 62, 64 or other threaded or unthreaded fasteners are inserted into these holes, then into the holes 47, 48 in the azimuth plates 38, 40, to secure the arm 50 to the upper and lower azimuth plates 38, 40. As can be seen in FIGS. 3 and 4, the flattened section 58 has raised edges 70 that sandwich a recess 72 within which the holes 60, 61 are located. It should also be understood that the bolt 62 may be replaced with another variety of pivotal attachment, such as a pin, post, rivet or the like.

Figure 2:
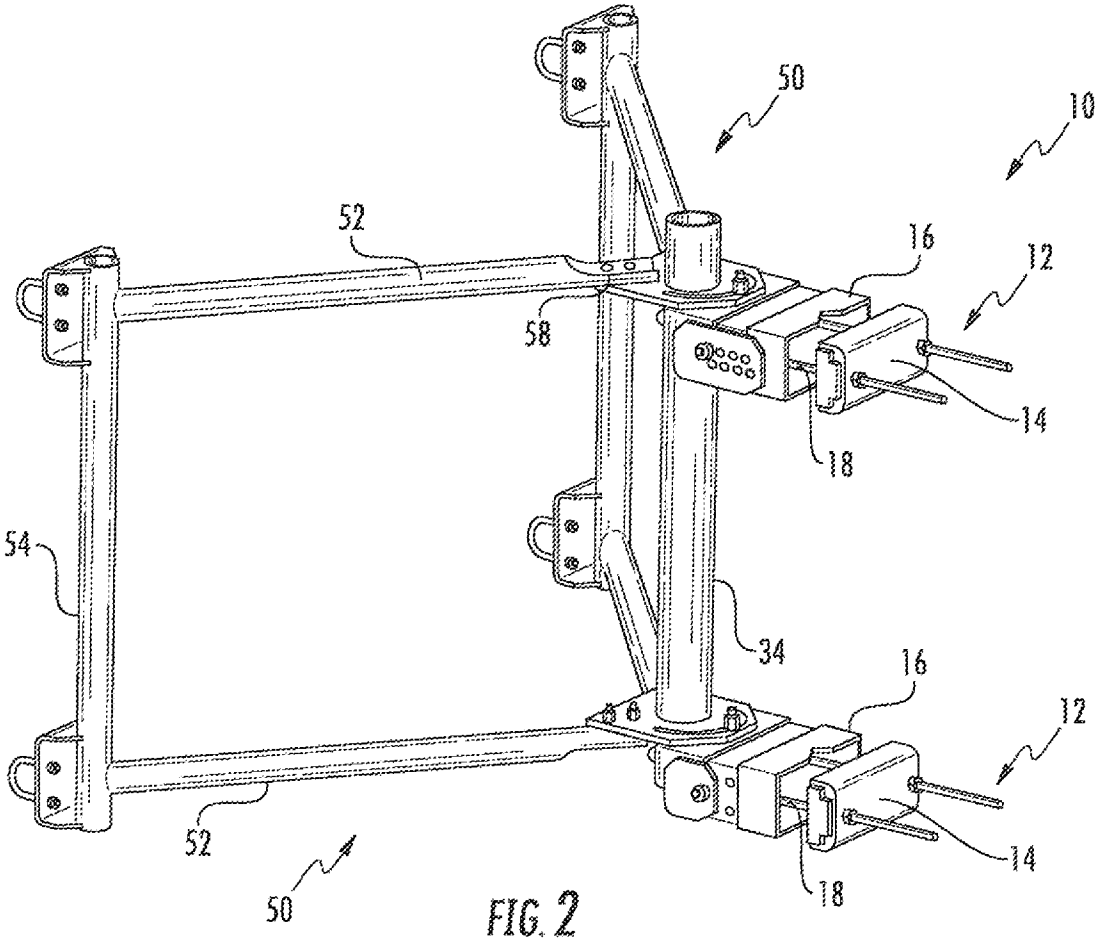
FIG. 2 is a rear perspective view of the antenna mount of FIG. 1.

Referring now to FIGS. 1 and 2, two equipment face mounting brackets 80, 82 are mounted at the intersections or vertices between the vertical run 54 and the horizontal runs 52 of each arm 50. Each of the equipment face mounting brackets 80, 82 includes a base panel 84 with mounting holes 86. The equipment face mounting brackets 80, 82 are welded or otherwise fixed to the arms 50 so that the base panels 84 are substantially coplanar to facilitate mounting of equipment.

Other aspects and features of the mount 10 are discussed in U.S. patent application Ser. No. 15/139,057, filed Apr. 26, 2016, the disclosure of which is hereby incorporated herein in its entirety. Other, exemplary mounts are discussed in U.S. patent application Ser. No. 15/000,036, filed Jan. 19, 2016, the disclosure of which is hereby incorporated herein by reference in its entirety.

Figure 5:
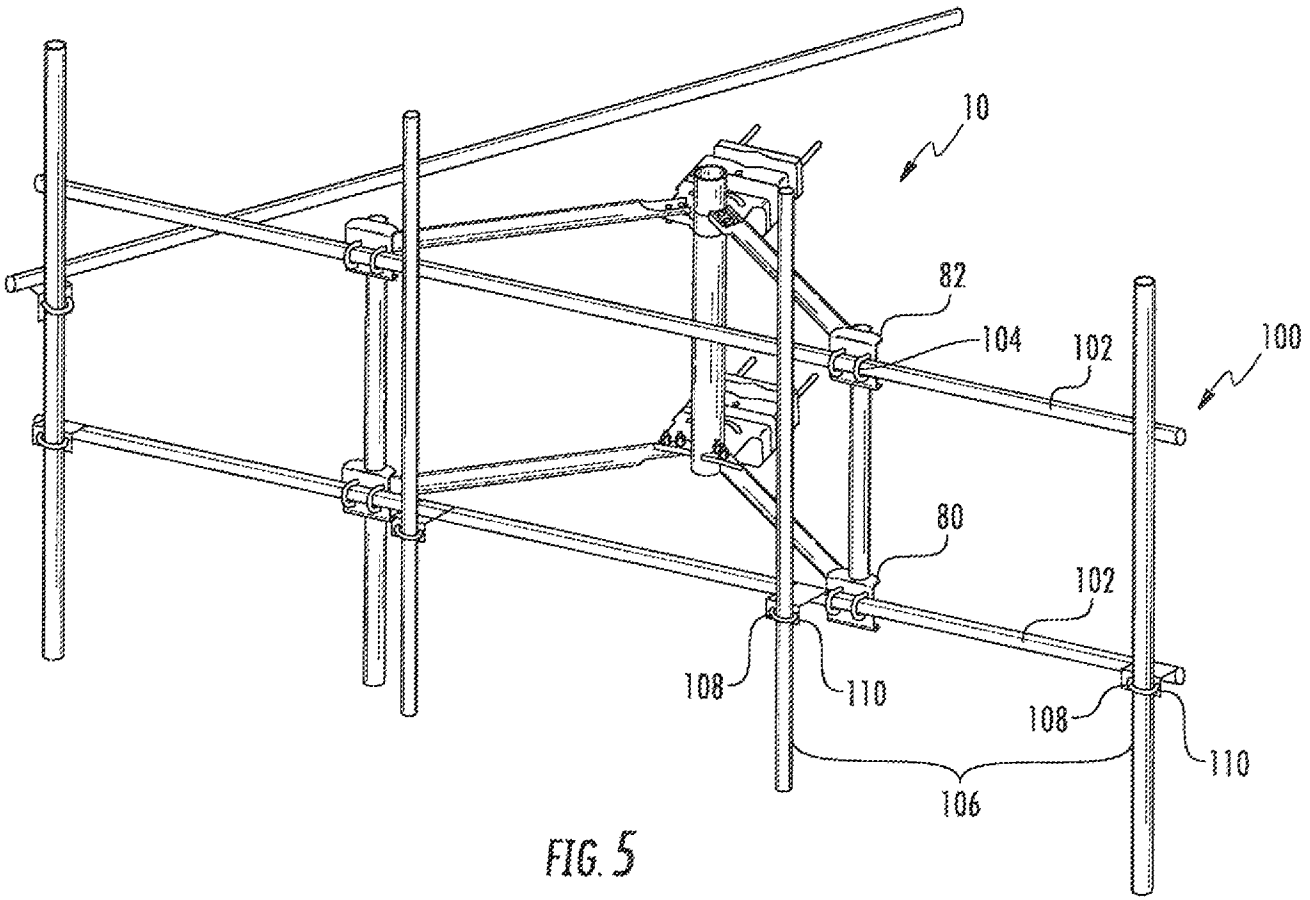
FIG. 5 is a front perspective view of the antenna mount and frame of FIG. 3.

Referring now to FIG. 5, a typical frame 100 for antenna mounting is shown mounted to the equipment face mounting brackets 80, 82. The frame 100 includes two horizontal members 102 that are mounted to the equipment face mounting brackets 80, 82 via U-bolts 104 or the like. Notably, the horizontal members 102 are positioned at essentially the same elevation as the horizontal runs 52 of the arms 50, which can reduce EPA. Vertical members 106 (in the illustrated embodiment four vertical members 106 are present) are mounted to the horizontal members 102 via U-bolts 108 inserted into holes in mounting brackets 110 fixed to the horizontal members 102. The vertical members 106 then provide mounting locations for antennas.

Figure 6:
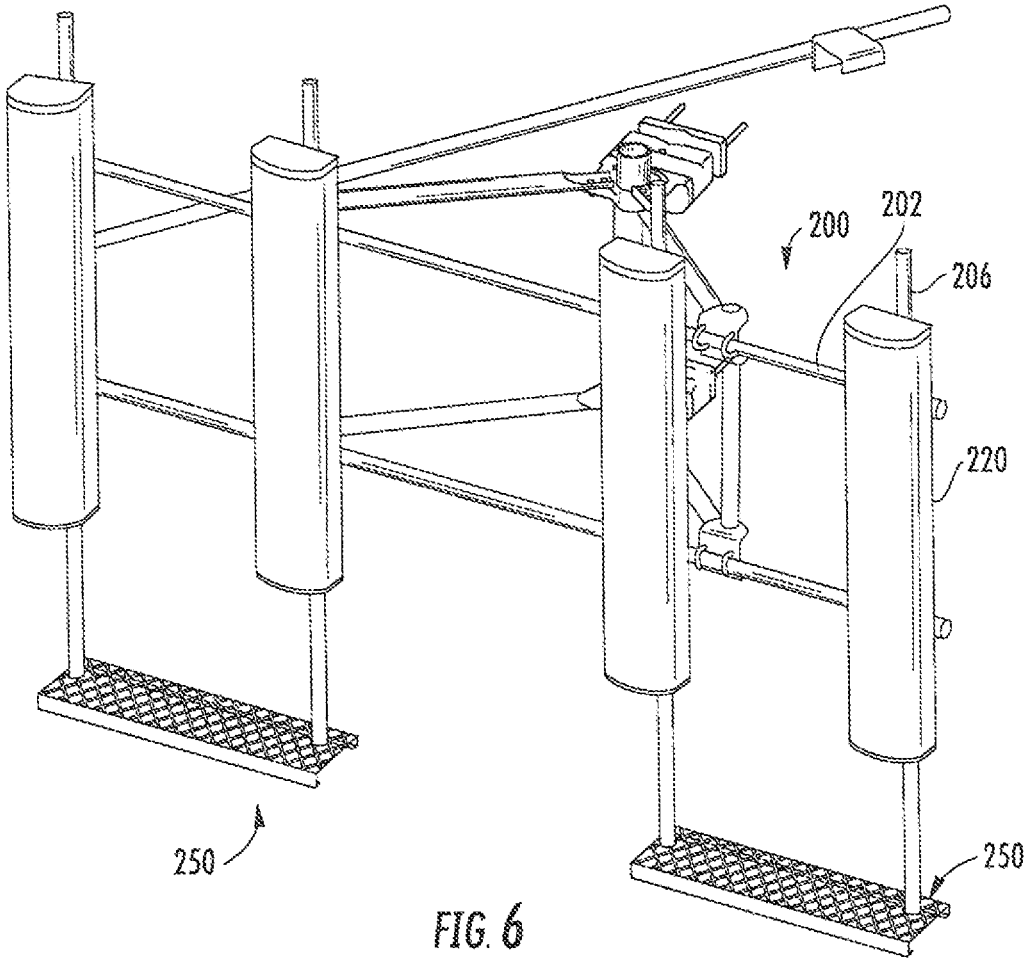
FIG. 6 is a front perspective view of the antenna mount and frame of FIG. 5 with antennas and work platforms mounted thereon according to embodiments of the invention.

Referring now to FIG. 6, a frame 200 is shown therein that includes two platforms 250 for supporting a technician. As can be seen in FIG. 6, the frame 200 includes horizontal members 202 attached to vertical members 206 in the manner discussed above (i.e., via U-bolts or welding) and antennas 220 are attached to the vertical members 206. However, the vertical members 206 extend downwardly sufficiently that the platforms 250 can be attached to the lower ends of the vertical members 206.

Figure 7:
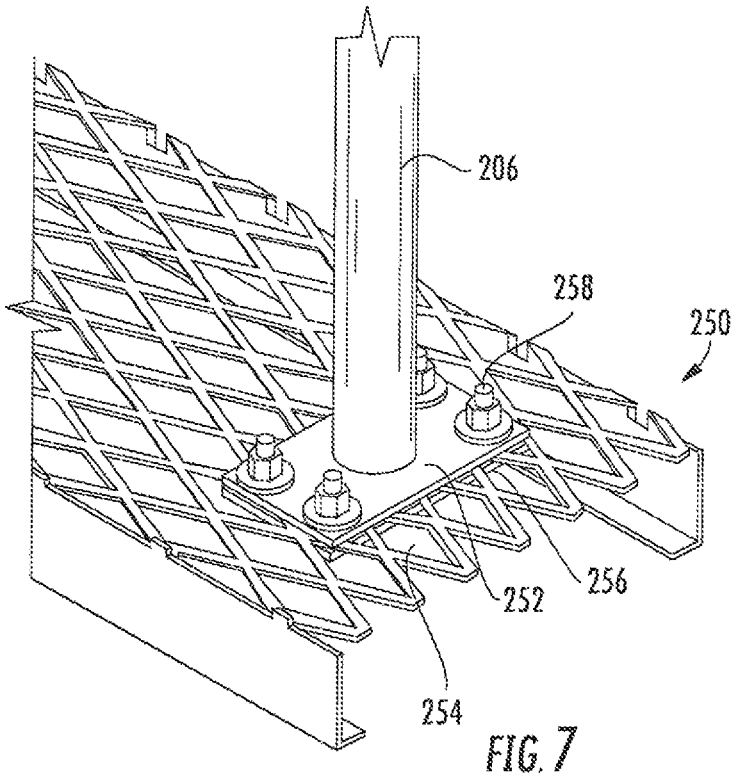
FIG. 7 is an enlarged partial perspective view of the attachment of a vertical member of the frame of FIG. 6 to the platform.

The platforms 250 may be attached to the lower ends of the vertical members 206 via a welded or bolted joint, or in other ways known to those of skill in this art. As shown in FIG. 7, in some embodiments, a flat plate 252 is welded to the lower end of each of the vertical members 206. Bolts 258, screws or the like can be inserted into the flat plate 252 and the platform 250 to fasten the platform 250 to the vertical members 206.

In some embodiments, such as that shown in FIG. 7, the platform 250 is an open grid with a pattern of interstices 254, which may facilitate the attachment of the platform 250 to the vertical members 206 irrespective of the distance between the vertical members 206. In the illustrated embodiment, a second flat plate 256 is positioned under the grid of the platform 250 to receive the bolts 258 and secure the platform 250 to the vertical member 206.

Figure 8:
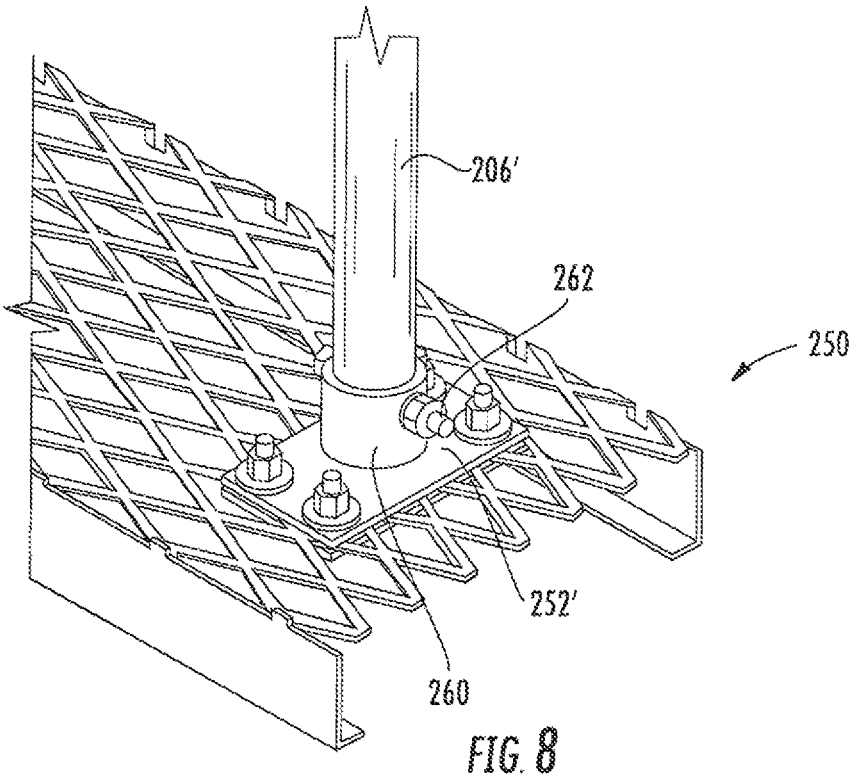
FIG. 8 is an enlarged perspective view of the attachment of a vertical member of the frame of FIG. 6 to a platform according to alternative embodiments of the invention.

FIG. 8 illustrates an embodiment in which a platform 250 may also be retrofitted to an existing mount 200. In such an instance, a technician may drill holes in the lower ends of the vertical members 206'. A flat plate 252' that has a mounting sleeve 260 fixed to its upper surface is then attached to the lower ends of the vertical members 206' with screws or bolts 262 inserted into the sleeve 260 and the just-drilled holes in the vertical members 206'. The platform 250 can then be attached to the flat plate 252' as discussed above.

As noted, in the illustrated embodiment, the vertical members 206, 206' to which the platform 250 is mounted are utilized as the supports for the antennas 220. In other embodiments, remote radio units (RRUs) may also be mounted to the vertical members 206. In still further embodiments, RRUs or other equipment may be mounted on a separate frame from the antennas, and the vertical members of the frames on which the RRUs are mounted may also serve as amounting location for the platform.

Figure 13:
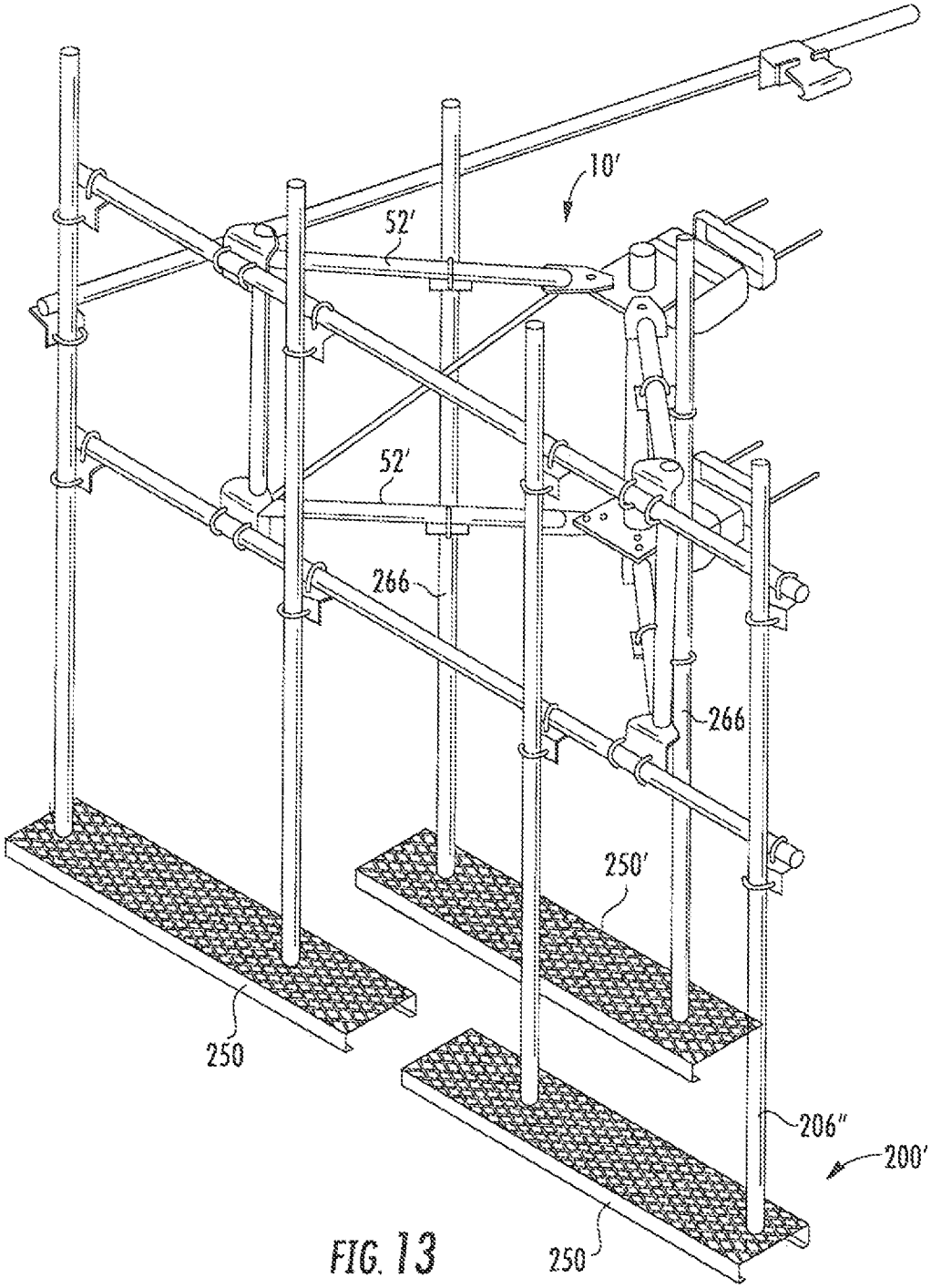
FIG. 13 is a perspective view of an antenna mount and equipment frame with three work platforms mounted thereon.

FIG. 13 illustrates another embodiment of an antenna mount 10' and an equipment frame 200' in which two platforms 250 are mounted to vertical members 206" of the equipment frame 200', and a third platform 250' is mounted to vertical members 266 that are attached to the upper and lower horizontal runs 52' of the antenna mount 10'. Those skilled in this art will recognize that additional platforms may be added (for example, a second platform 250' may be added, with one platform 250' being mounted on each pair of upper and lower horizontal runs 52' of the antenna mount 10').

The use of at least two horizontal members 202 as attachment points, for each vertical member 206 provides multiple points to withstand the tangential forces applied by a technician's weight when he is positioned on the platform 250. In some embodiments, each vertical member 206 may be attached to three or more horizontal members 202.

Figure 9:
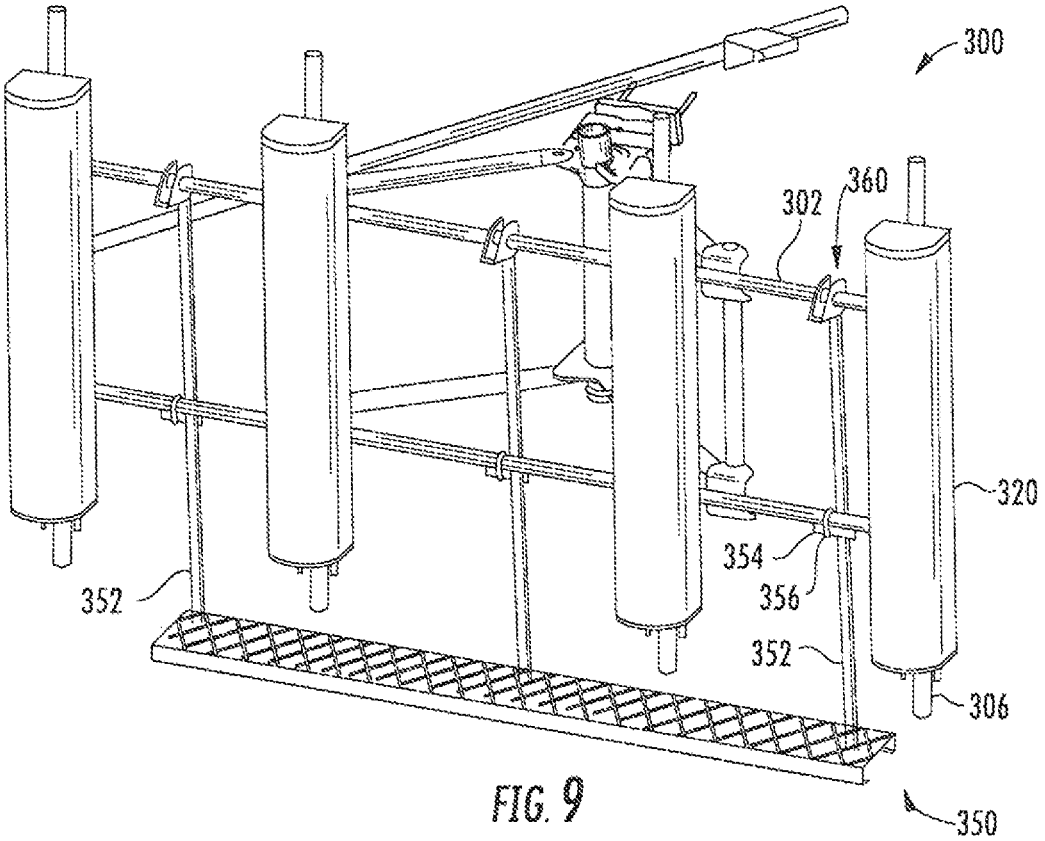
FIG. 9 is a front perspective view of the antenna mount and frame of FIG. 5 with antennas and a work platform mounted thereon according to further embodiments of the invention.

Another embodiment of a mount, designated broadly at 300, is shown in FIG. 9, The mount 300 has horizontal members 302, vertical members 306, and antennas 320 like the mount 200 above. However, a platform 350 that is somewhat longer than the platform 250 is attached to the mount 300 via three, support posts 352. Each of the support posts 352 is attached to the lower horizontal member 302 via a U-bolt 354 and a mounting bracket 356 that is welded to the lower horizontal member 302. At its upper end, each, of the support posts 352 is attached to the upper horizontal member 302 via a two-piece locking bracket 360, which is described in greater detail below.

Figure 10:
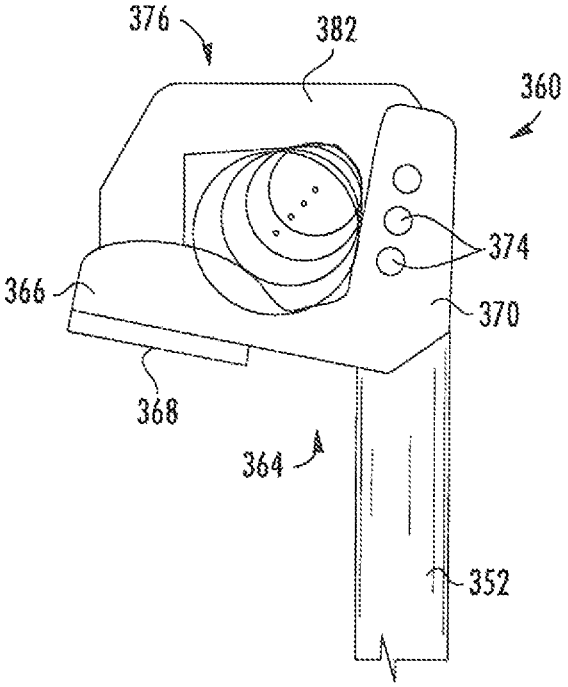
FIG. 10 is an enlarged partial side view of a locking bracket for mounting the platform on the frame as in FIG. 9.

The locking bracket 360 (see FIGS. 10 and 11) has a lower U-shaped channel 364 with side walls 366 and a floor 368. Fingers 370 extend from the side walls 366. A slot 372 is present in the floor 368. Each finger 370 includes three aligned holes 374. The locking bracket 360 also includes an upper U-shaped channel 376 with a floor 378 and side walls 380. L-shaped fingers 382 extend from the side walls 380 and are welded to opposite sides of the upper end of the support post 352. A hole 384 is present in the floor 378, and another hole 386 is present in each finger 382.

Figure 11:
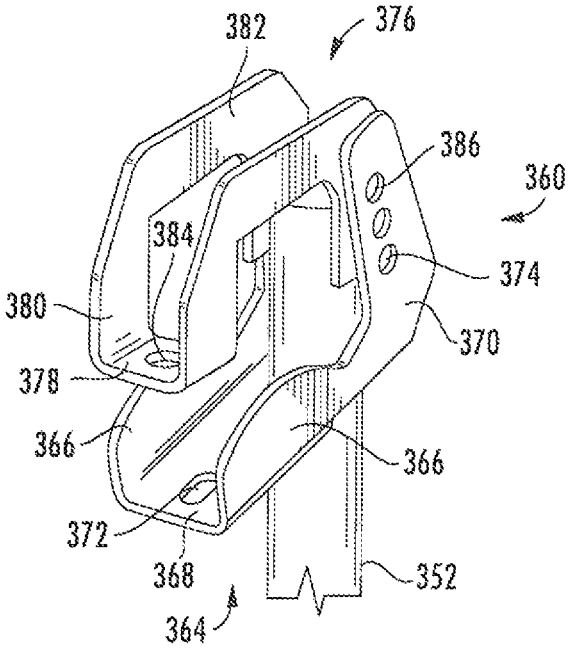
FIG. 11 is an enlarged partial perspective view of the locking bracket of FIG. 10.

As can be seen in FIG. 11, the lower channel 364 is pivotable relative to the upper channel 376 and the support post 352; a pin, post, bolt or the like can be inserted through a selected aligned hole 374 in each finger 370 and through the holes 386 in the fingers 382 to fasten the lower and upper channels 362, 376 together and provide a pivot point. The lower channel 364 is pivoted relative to the upper channel 376 until the floors 368, 378 contact each other. In this position the slot 372 in the floor 368 aligns with the hole 384 in the floor 378, such that the lower and upper channels 364, 376 can be fixed with a bolt (not shown) inserted through the slot 372 and holes 384. The ability of the lower channel 364 to pivot can enable the locking bracket 360 to lock onto horizontal members 302 of different diameters. The presence of the fingers 378 of the upper channel 376 resting on and above the horizontal member 302 significantly reduces the risk of vertical slippage of the support posts 352 (and in turn the platform 350) due to load or hardware failure.

Also, the platform 350 can be easily retrofitted onto an existing mount (such as the mount 300) with minimal impact to equipment attached to the mount 300.

Figure 12:
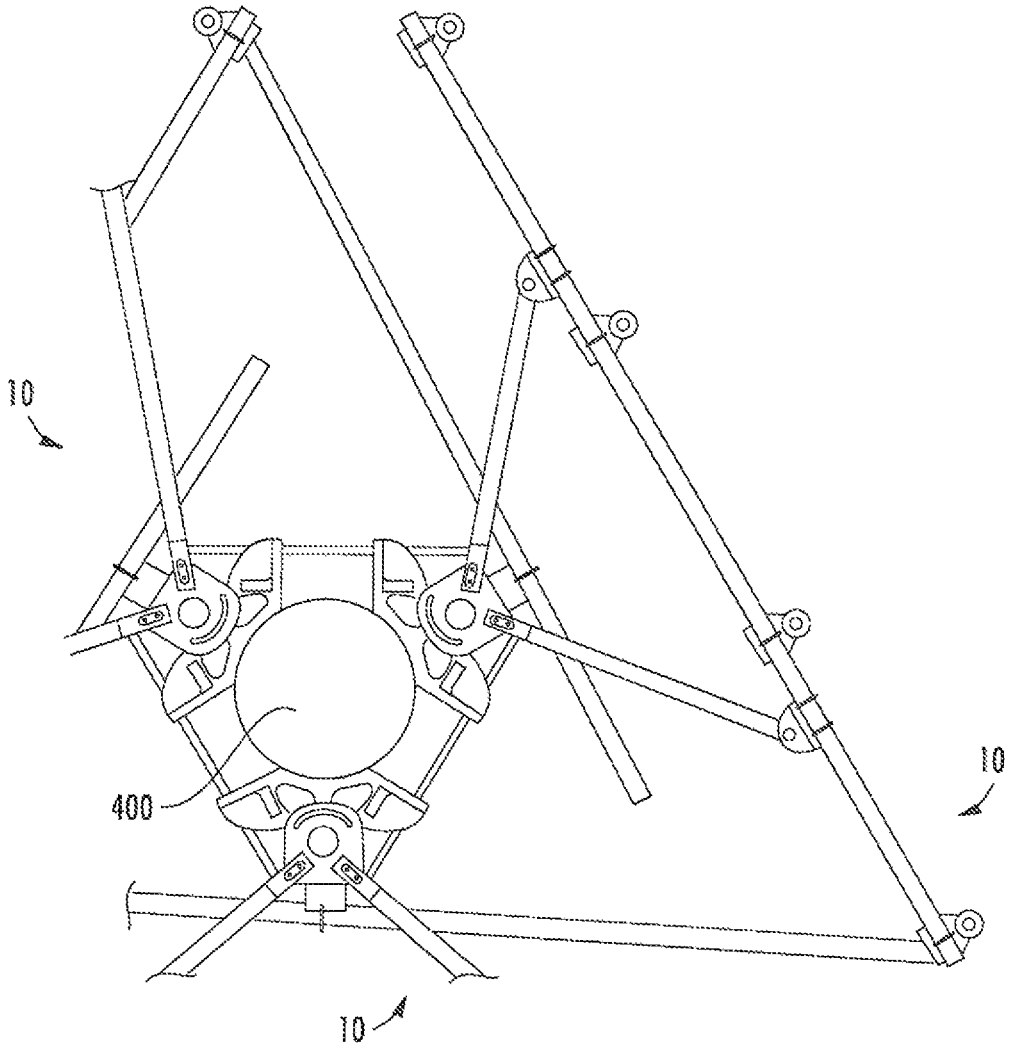
FIG. 12 is a partial top view of three antenna mounts and frames of FIG. 5 mounted to a monopole via a ring mount.

Although the mounts 200, 300 and platforms 250, 350 are illustrated for mounting to a leg of an antenna tower, those skilled in this art will appreciate that the mounts 200, 300 may also be mounted to other structures. For example, FIG. 12 illustrates three mounts 10 attached to a monopole 400. The platforms 250, 350 may be attached to the mounts 10 as discussed above. Other structures that may benefit from an elevated platform may also be suitable for use with embodiments of the platforms discussed above (e.g., scaffolding).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

That which is claimed is:

1. An antenna tower, comprising:

a generally vertically disposed tower structure;

three antenna mounts mounted to the tower structure;

three antenna frames, each of the antenna frames mounted to a respective antenna mount, wherein at least one piece of communications equipment is mounted to each of the antenna frames; and three work platforms, each of the work platforms suspended from a respective antenna mount or to a respective antenna frame and extending radially outwardly from the respective antenna mount or antenna frame relative to the tower structure.

2. The antenna tower defined in claim 1, wherein the at least one piece of communications equipment is an antenna and/or a remote radio unit.

3. The antenna tower defined in claim 1, wherein at least one of the antenna frames comprises a plurality of horizontal members and a plurality of vertical members mounted on the horizontal members, and wherein the corresponding work platform is mounted on at least two of the vertical members of the antenna frame.

4. The antenna tower defined in claim 1, wherein at least one of the work platforms includes at least two vertical members, the vertical members being mounted to the antenna frame or the antenna mount.

5. The antenna tower defined in claim 4, wherein each of the vertical members of the work platform includes a locking bracket that engages a horizontal member of the antenna frame or a horizontal member of the antenna mount.

6. The antenna tower defined in claim 1, wherein the antenna tower structure is a monopole.

* * * * *